United States Patent [19]

Himmens

[11] Patent Number: 4,819,626

[45] Date of Patent: Apr. 11, 1989

[54] CONTAMINATION PREVENTION DEVICE FOR DIVER'S BREATHING APPARATUS

[75] Inventor: Ian A. Himmens, Portsmouth, England

[73] Assignee: The Secretary of State for Defence in her Majesty's Government of the United Kingdom of Great Britain and Northern Ireland, London, England

[21] Appl. No.: 120,375

[22] Filed: Nov. 13, 1987

[30] Foreign Application Priority Data

Nov. 14, 1986 [GB] United Kingdom ..... 8627323

[51] Int. Cl.[4] ..... A62B 18/00

[52] U.S. Cl. ..... 128/201.28; 128/204.26; 128/205.24

[58] Field of Search ..... 128/201.27, 201.28, 128/201.29, 204.26, 204.29, 205.19, 205.24, 205.22, 201.24, 200.29, 206.21, 206.24, 200.27, 200.28, 201.12, 201.18, 201.25, 205.25, 205.27, 206.12, 206.22, 206.28, 201.11, 202.14

[56] References Cited

U.S. PATENT DOCUMENTS

| | | | |
|---|---|---|---|
| 2,906,262 | 9/1959 | Braunstein | 128/202.14 |
| 3,028,859 | 4/1962 | Mitchell | 128/204.26 |
| 3,050,055 | 8/1962 | Vautiz | 417/61 |
| 3,343,535 | 9/1967 | Plytle et al. | 128/206.24 |
| 3,348,539 | 10/1967 | McDonald | 128/200.29 |
| 3,370,586 | 2/1968 | Araqona et al. | 128/201.11 |
| 3,547,146 | 12/1970 | Jones | 137/512 |
| 3,680,555 | 8/1972 | Warncke | 128/206.24 |
| 4,250,877 | 2/1981 | Owens et al. | 128/205.25 |
| 4,467,797 | 8/1984 | Franke | 128/204.26 |
| 4,608,976 | 9/1986 | Suchy | 128/201.28 |

FOREIGN PATENT DOCUMENTS

| | | | |
|---|---|---|---|
| 843992 | 8/1960 | United Kingdom . | |
| 1174553 | 12/1969 | United Kingdom | 128/204.26 |
| 1317172 | 5/1973 | United Kingdom . | |
| 1446881 | 8/1976 | United Kingdom | 128/204.26 |
| 1462361 | 1/1977 | United Kingdom . | |
| 2038187 | 7/1980 | United Kingdom . | |
| 2131702A | 6/1984 | United Kingdom . | |

*Primary Examiner*—Edgar S. Burr
*Assistant Examiner*—Kimberly L. Asher
*Attorney, Agent, or Firm*—Nixon & Vanderhye

[57] ABSTRACT

A diver's mask for use in contaminated water includes a shroud (12) which manifolds the demand regulator exhale port (7) with a second exhale port (9) from the diver's oral/nasal mask (2) to form a gas filled cavity (11). The shroud (12) has an outlet port (13) to the surrounding water (15). When the diver breathes out exhaled gas enters the cavity (11) and the pressure causes the non-return valve (14) of the outlet port (13) to open, allowing gas to escape from the cavity (11) into the surrounding water (15). When the diver stops exhaling, the pressure of the water (15) causes the non-re turn valve (14) to close, leaving a residue of exhaled gas in the cavity (11). When the diver inhales again, the outlet port non-return valve (14) prevents water being drawn into the cavity (11) and non-return valves (8,10) of the exhale ports (7,9) prevent the exhaled gas from being drawn back into the inhaled gas.

6 Claims, 3 Drawing Sheets

CONTAMINATION PREVENTION DEVICE FOR DIVER'S BREATHING APPARATUS

BACKGROUND OF THE INVENTION

The invention relates to open circuit, demand type breathing apparatus as used by divers, particularly but not exclusively, for use in contaminated waters.

A common type of breathing apparatus is the open circuit, demand type which uses a demand regulator fitted to a rigid mask frame and flexible hood assembly (termed "bandmasks"). Alternatively the demand regulator can be fitted to a hard helmet assembly. This type of breathing apparatus operates on "demand"—when the diver breathes in breathing gas is drawn in through an inhale port on the demand regulator into an oral/nasal mask cavity, and when the diver breathes out the exhaled gas passes out through an exhale port directly into the ambient water. The exhale port is fitted with a non-return valve to prevent exhaled gas or water being drawn in when the diver inhales. These known types of equipment, however, have the disadvantage that they cannot totally prevent ingestion of water by the diver. Water ingress occurs during the inhalation phase of the diver's breathing cycle, when water droplets are sucked past the exhale non-return valve in the demand regulator body and thence into the diver's lung via the oral/-nasal mask cavity. This can be dangerous if the diver is in contaminated water and is undesirable even in uncontaminated conditions. The exhale non-return valve is the prime leakage path into the mask.

There are alternative types of breathing apparatus available which deal with the problem of possible contamination in different ways. One type is the closed circuit system in which possible contamination is prevented by sealing the system from the ouside water. Another type is the open circuit, positive pressure system in which possible contamination is avoided by keeping an excess pressure of gas in the mask to prevent contaminating material entering the mask. Neither of these ways of preventing contamination are applicable to the open circuit, demand type of breathing apparatus.

SUMMARY OF THE INVENTION

The object of the invention is to provide a diver's breathing apparatus of the open circuit, demand type, in which the entry of water into the diver's mask, such that it can be breathed in, is eliminated.

The invention provides a diving mask including a means to prevent water entering into the inhale gas in a diver's open circuit, demand type breathing apparatus, wherein the means comprises:

(a) enclosure means adapted to fit in a water-tight fashion over the exhale port non-return valve of the demand regulator of the diver's breathing apparatus to form a gas filled cavity;

(b) a second exhale port, fitted with a non-return valve, from the diver's mask to the cavity created by the enclosure means; and (c) at least one enclosure means exhale port, incorporating a non-return valve;

wherein the enclosure means forms a manifold around the demand regulator exhale port and the second exhale port, through which in use the diver's exhaled breathing gas passes before exiting to the surroundings through the enclosure means exhale port.

Preferably the enclosure means is formed by a rigid shroud. Alternatively it may be formed of a shroud of a flexible material. Preferably the shroud is adapted for adhesive fixing to the diver's mask though any suitable means of water-tight sealing may be used.

With open circuit, demand type breathing apparatus it is important that the breathing resistance, both on inhale and exhale, is not excessive. The second exhale port from the diver's mask into the cavity has been found to be an important factor in reducing the exhale breathing resistance to acceptable levels. Although described in relation to one exhale port from the demand regulator and one second exhale port from the oral/nasal mask any number, size and configuration can be used as required.

Each inhale port is fitted with a non-return valve to prevent rebreathing of the gas contained within the cavity created by the enclosure means.

It has been found preferable to use two outlet ports from the gas filled cavity to the surrounding water, though any suitable number, size and arrangement can be used.

Advantageously a deflection means may be provided to deflect bubbles of exhaled gas away fron the visor of the mask.

In use the water-ingress prevention means operates in the following manner: when the diver breathes out the exhaled gas is passed, via the non-return valves, through the exhale ports into the cavity created by the enclosure means. The gas held in the cavity is discharged via the outlet port non-return valves in the enclosure means into the surrounding water. The last portion of the exhaled breath is retained in the cavity by the action of the outlet non-return valves which are usually held closed by the pressure of the water acting on them.

Only minimal breathing effort is required to open the outlet port non-return valves to permit the egress of the exhaled breathing gas.

BRIEF DESCRIPTION OF THE DRAWINGS

The invention will now be further described, by way of example only, with reference to the accompanying drawings of which.

DETAILED DESCRIPTION OF PREFERRED EMBODIMENTS

Figure 1:
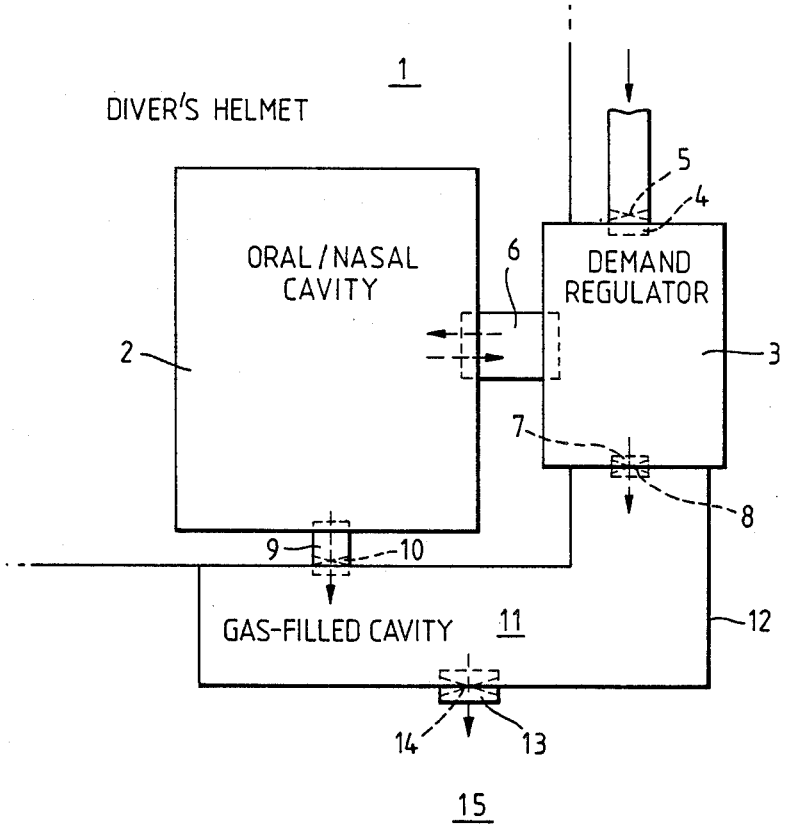
FIG. 1 shows a block diagram representation of a diver's helmet fitted with a contamination prevention means according to the invention.

As shown in FIG. 1, a diver's helmet includes an oral/nasal mask 2 which can fit over a diver's nose and mouth. A breathing gas demand regulator 3 is fitted to the front of the helmet 1. When a diver wearing the helmet breathes in, breathing gas is drawn into the demand regulator 3 from an inhale port 4 via a non-return valve 5. The gas then passes through an inlet/outlet port 6 to the cavity of the oral/nasal mask 2 from whence it is inhaled by the diver.

When the diver exhales, the gas passes out from the oral/nasal mask 2 by two routes. It can flow through the inlet/outlet port 6 to the demand regulator 3 and thence out through a demand regulator exit port 7 with a non-return valve 8. The non-return valve 5 prevents exhaled gas passing out through the inhale port 4. The exhaled gas can also leave the oral/nasal mask 2 through a second exhale port 9 which leads from the base of the oral/nasal mask 2 out through the body of the helmet 1. The exhale port 9 includes a non-return valve 10. The exhaled gas, passing through the exhale ports, 7 and 9, enters a gas filled cavity 11. The cavity 11 is created by a shroud 12 which encloses the exhale ports, 7 and 9, and is sealed to the helmet 1 and the demand regulator 3 in a gas- and water-tight manner. The shroud 12 includes an outlet port 13, with a non-return valve 14, such that when exhaled gas enters the cavity 11, the pressure causes the non-return valve 14 to open and gas escapes from the cavity 11 into the surrounding water 15. When the diver stops exhaling, the pressure of the surrounding water 15 causes the non-return valve 14 to close, leaving a residue of exhaled gas in the cavity 11. When the diver inhales again, the non-return valves 8 and 10 prevent the exhaled gas from being drawn back into the oral/nasal mask 2 or the demand regulator 3. The non-return valve 14 prevents water being drawn into the cavity 11. Any water that may seep in will be prevented from entering the inhale gas by the non-return valves 8 and 10, and will be expelled on the next exhale cycle. Thus contamination of the breathing gas by the surrounding water 15 is prevented.

Figure 2:
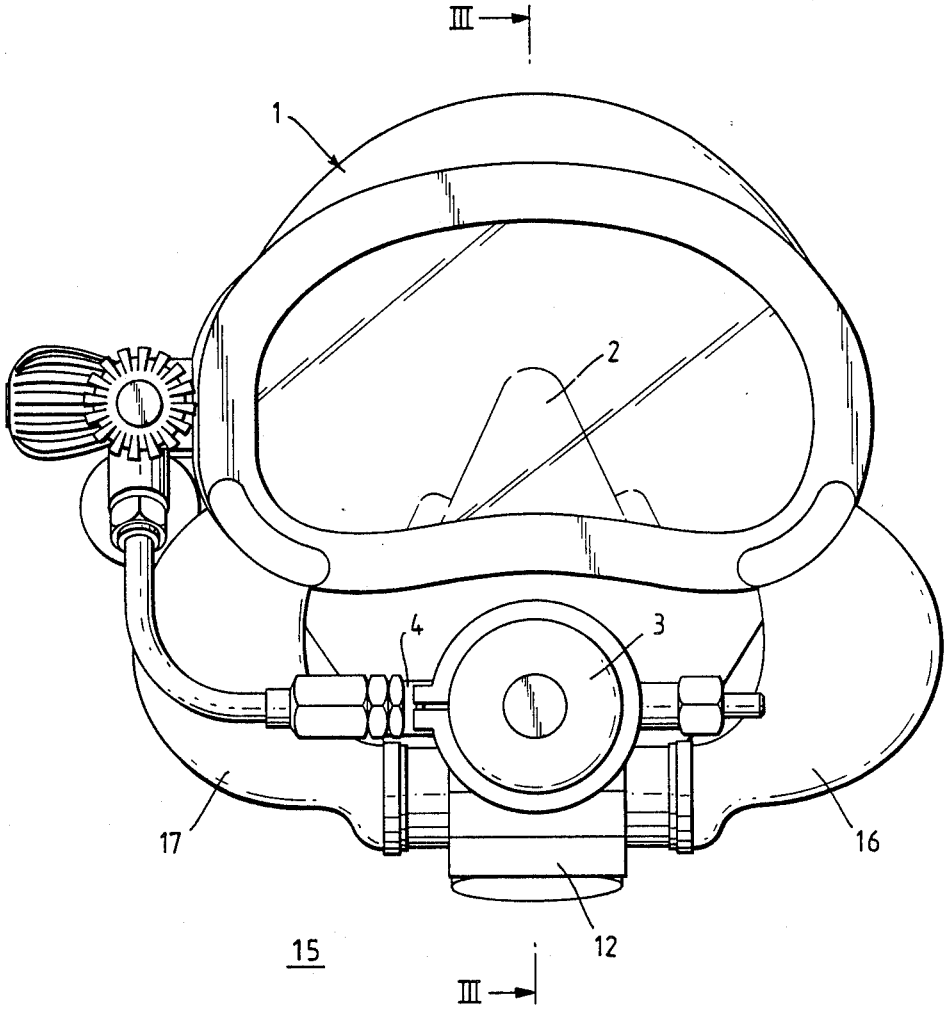
FIG. 2 shows a front view of a diver's mask fitted with one arrangement of the contamination prevention means according to the invention.
Figure 3:
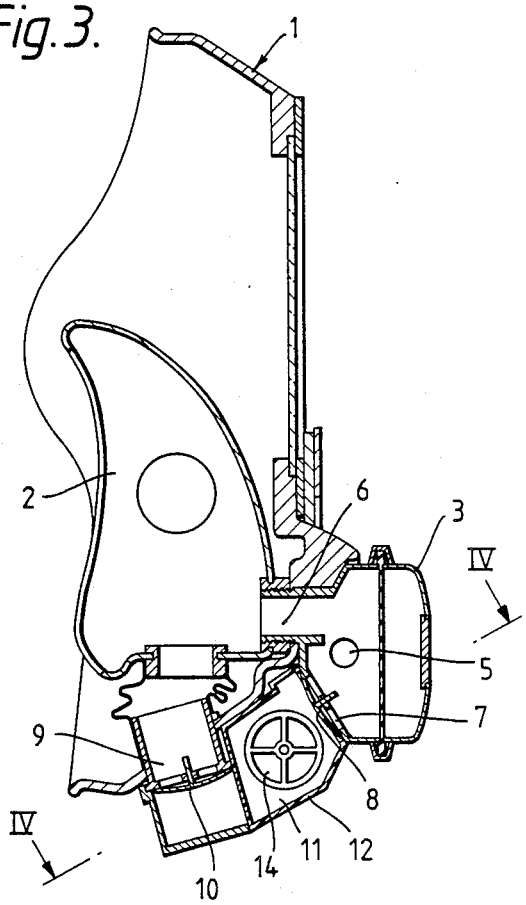
FIG. 3 is a cross-sectional view along the line III—III of FIG. 2.
Figure 4:
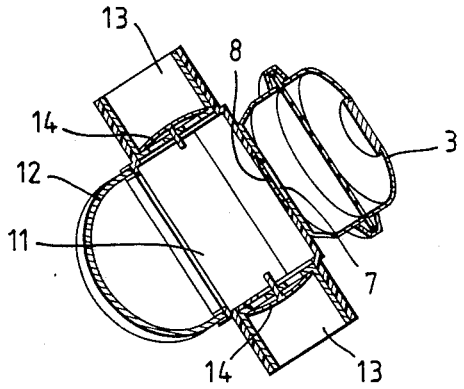
FIG. 4 is a cross-sectional view along the line IV—IV of FIG. 3.

In FIGS. 2, 3 and 4 one particular arrangement of the contamination prevention means represented in FIG. 1 is shown fitted to a diver's mask. The shroud 12 is made of a rigid, plastics material and is attached to the demand regulator 3 and the mask 1 by means of an adhesive sealant so that it is fitted in a water- and gas-tight manner over the demand regulator exit port 7 and the second exhale port 9. The non-return valves 8 and 10 of the respective exit ports are in the form of mushroom valves. There are two outlet ports 13 from the cavity 11 to the surrounding water 15, each with a non-return valve 14 in the form of a mushroom valve. The exhaled gas exiting from the outlet port 13 is deflected away from the diver's face by bubble deflectors 16 and 17 attached to the mask 1.

Any suitable diving mask as used at present can be adapted to incorporate the invention with very few modifications being required.

I claim:

1. A diver's mask comprising:

a mask frame;

a face visor;

an oral/nasal cavity within said mask frame;

breathing gas demand regulator having an inhale port fitted with a non-return valve, an exhale port fitted with a non-return valve and an inlet/outlet port connected to said oral/nasal cavity;

a second exhale port directly from said oral/nasal cavity through said mask frame; and an enclosure means, fitted in a water/tight fashion over said demand regulator exhale port and said second exhale port, for forming a gas-filled cavity, said enclosure means having at least one exhale port incorporating a non-return valve, wherein said enclosure means comprises a manifold around the demand regulator exhale port and said second exhale port, through which, in operation, a diver's exhaled breathing gas passes before exiting to the surroundings through said enclosure means exhale port.

2. A diver's mask according to claim 1 wherein the enclosure means is formed by a rigid shroud.

3. A diver's mask according to claim 1 wherein the enclosure means is formed by a shroud of a flexible material.

4. A diver's mask according to claim 2 or claim 3 wherein the shroud is adhesively fixed to the diver's mask.

5. A diver's mask according to claim 1 wherein the enclosure means includes two exhale ports from the gas filled cavity to the surroundings.

6. A diver's mask according to claim 1 wherein deflection means are attached to the mask to deflect bubbles of exhaled gas away from the visor of the mask.

* * * * *